US007017620B2

(12) United States Patent
Mettler et al.

(10) Patent No.: US 7,017,620 B2
(45) Date of Patent: Mar. 28, 2006

(54) HEDDLE

(75) Inventors: Franz Mettler, Wollerau (CH); Herbert Schwane, Raesfeld (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/867,775

(22) Filed: Jun. 16, 2004

(65) Prior Publication Data

US 2005/0016613 A1 Jan. 27, 2005

(30) Foreign Application Priority Data

Jun. 17, 2003 (DE) ..... 103 30 304

(51) Int. Cl.
*D03C 9/00* (2006.01)

(52) U.S. Cl. ..... 139/93

(58) Field of Classification Search ..... 139/52, 139/53, 92, 93

See application file for complete search history.

(56) References Cited

U.S. PATENT DOCUMENTS

| | | | | |
|---|---|---|---|---|
| 3,016,926 | A * | 1/1962 | Froehlich | 139/93 |
| 3,349,811 | A | 10/1967 | Kaufmann | |
| 3,417,789 | A | 12/1968 | Graf | |
| 3,430,313 | A * | 3/1969 | Koch | 28/205 |
| 5,052,446 | A | 10/1991 | Gysin | |
| 5,152,325 | A | 10/1992 | Koch | |
| 6,176,270 | B1 * | 1/2001 | Mettler | 139/93 |
| 6,230,756 | B1 | 5/2001 | Baumann et al. | |

FOREIGN PATENT DOCUMENTS

| | | |
|---|---|---|
| CA | 1 127 935 | 7/1982 |
| GB | 2 043 123 A | 10/1980 |

* cited by examiner

*Primary Examiner*—John J. Calvert
*Assistant Examiner*—Andrew W. Sutton
(74) *Attorney, Agent, or Firm*—Fitch, Even, Tabin & Flannery; Norman N. Kunitz; George H. Spencer

(57) ABSTRACT

In a heddle (6), the slender heddle shank (21) has been lengthened, at the cost of the end eyelets (7, 8) and the yarn eyelet region (29). This is accomplished on the one hand by shortening the end eyelet regions (7, 8) to their absolute minimum length and on the other by placing the auxiliary openings (38), which serve to transport the heddles, closer to the end eyelets (7, 8). The radii R in the region of the end eyelets (7, 8) are reduced. Instead of the usual 2 mm width, the heddle shank (21) still has a maximum width of 1.6 mm. The regions (14, 13) of the heddle (6) that protrude past the end openings still have, instead of the usual length of 4 mm, a length of 2.5 mm to 3 mm. Directly around the yarn eyelet (33), the heddle has a width which, as before, is equivalent to twice the width of the yarn eyelet (33). However, the length of this region is shortened to a maximum of twice to three times the yarn eyelet width. The transition from the narrowest zone (27, 28) of the heddle shank (21) to the comparatively wide zone (29) around the yarn eyelet (33) is characterized by an elongated transition region (34), which has a maximum width of 1.8 mm and serves to reinforce this region against mechanical stresses.

22 Claims, 3 Drawing Sheets

HEDDLE

CROSS REFERENCE TO RELATED APPLICATIONS

This application claims the priority of German Patent Application No. 103 30 304.9, filed on Jun. 17, 2003, the subject matter of which, in its entirety, is incorporated herein by reference.

BACKGROUND OF THE INVENTION

The invention relates to a heddle, in particular for power looms.

Power loom heddles are known per se. As a rule, they have an elongated body, shaped from a metal sheet, with so-called end eyelets embodied on their upper and lower ends; these eyelets serve to secure them to the support rail of a heddle shaft. The heddle is provided approximately in the middle with a yarn eyelet, which serves to guide a warp thread. By suitable longitudinal motion of all the heddles, shedding is accomplished in the loom.

Similar heddles are in use for jacquard machines. However, they are retained individually on harness yarns or so-called laces and are tensed by a spring.

Power looms with heddles retained on a shaft are today running up against higher and higher operating speeds. This means increasingly longer shedding strokes and/or shortened motion times, and as a result the loads on all the shedding devices, which include the heddles, increase considerably and in fact disproportionately. Besides the heddles and the shafts, the shedding devices also include all the drive elements that move the shaft. Efforts to reduce the mass of the shedding devices have so far focused essentially on the heddle shafts.

With this as the point of departure, it is the object of the invention to propose provisions with which the operating speed of a power loom can be increased.

SUMMARY OF THE INVENTION

The above object is attained by optimizing the heddles held by the shaft utilizing the various basic features of the invention, individually or in partial or full combination with one another, which leads to a reduction in the mass of a heddle while preserving its stability and optionally while increasing its load-bearing capacity. If all the claimed provisions are employed jointly, the result is a fully functional heddle with a weight that is about 20% below the usual standard. This makes a considerable increase in the operating speed of a power loom and/or a reduction in the load on the heddles possible.

One essential provision for improving the heddle is to provide one or more openings in the tapering end eyelet region, which compared to previously known heddles occupy an increased area. It has been demonstrated that more than one-eighth the total area of the tapering end eyelet region can be occupied by these openings. In preferred embodiments, the openings occupy an area which amounts to more than one-third and preferably more than half the total area of the tapering end eyelet region. If there are more than one opening, the spacing between them is preferably less than the length of one of the two openings. Preferably, the spacing is less than the length of the shorter opening. The weight reduction in the immediate vicinity of the end eyelet not only has a generally favorable effect but also reduces wear to a great extent. Simultaneously, the stability of the heddle is preserved entirely, particularly in the region of its end eyelet. The openings can lend the tapering end eyelet region a certain resilience and thus a buffer effect. With regard to impacts or shocks, the transition region can be considered a spring means.

Preferably, the tapering end eyelet region has an edge curved in an arc, whose radius is less than or equal to 60 mm. This provisions reduces the area of the tapering end eyelet region compared to conventional heddles, which contributes to reducing the weight without losing strength.

The end eyelet of the heddle is preferably formed by a jaw opening, with a jaw end region whose thickness measured in the longitudinal direction is preferably greater than the width of the material otherwise surrounding the jaw opening. Measured in the longitudinal direction, the length of the end region of the jaw is preferably at most 3 mm, and in turn it is preferably greater than 2 mm to 2.5 mm. Thus the end eyelet has good strength and at the same time low weight.

The width of the heddle shank is preferably reduced to a value of at most 1.6 mm, for the narrowest region. The heddle shank may have a width which is less than the width of the yarn eyelet. It has been shown that the associated weight reduction compensates for the reduction in tensile strength of the heddle, from the fact that heddle breakages, following the reduction of their shank width to a range of approximately 1 mm to 1.6 mm, decrease, or in any case do not increase. This is attained by the reduction in the weight of the heddles, which has a favorable effect on the entire shedding system.

The yarn eyelet is preferably located in a yarn eyelet region whose width is greater than that of the rest of the heddle shank; the yarn eyelet region is embodied as relatively short. Its length amounts at most to five times the width of the yarn eyelet, and preferably at most three times that width. Because of this short embodiment of the yarn eyelet region, considerable weight is saved without a loss of strength.

The yarn eyelet region is preferably defined by straight edges. The transition to the heddle shank is preferably formed by a region curved in an S or an arc, and the radii of the arc are preferably less than 60 mm. As a result, short transitions with adequate strength are attained.

Between the yarn eyelet region and the narrowest part of the heddle shank, a transition region is preferably embodied that once again is embodied with parallel flanks; its width is greater than the width of the narrowest part of the heddle shank and is less than the width of the yarn eyelet region. The transition region increases the dynamic strength of the heddle shank, at simultaneously low weight. The length of the transition region is preferably greater than that of the yarn eyelet region.

Further details of advantageous embodiments of the invention will become apparent from the drawing, including the dimensions therein, the specification, or dependent claims.

BRIEF DESCRIPTION OF THE DRAWINGS

Exemplary embodiments of the invention are shown in the drawing. Shown are.

DETAILED DESCRIPTION OF THE INVENTION

Figure 1:
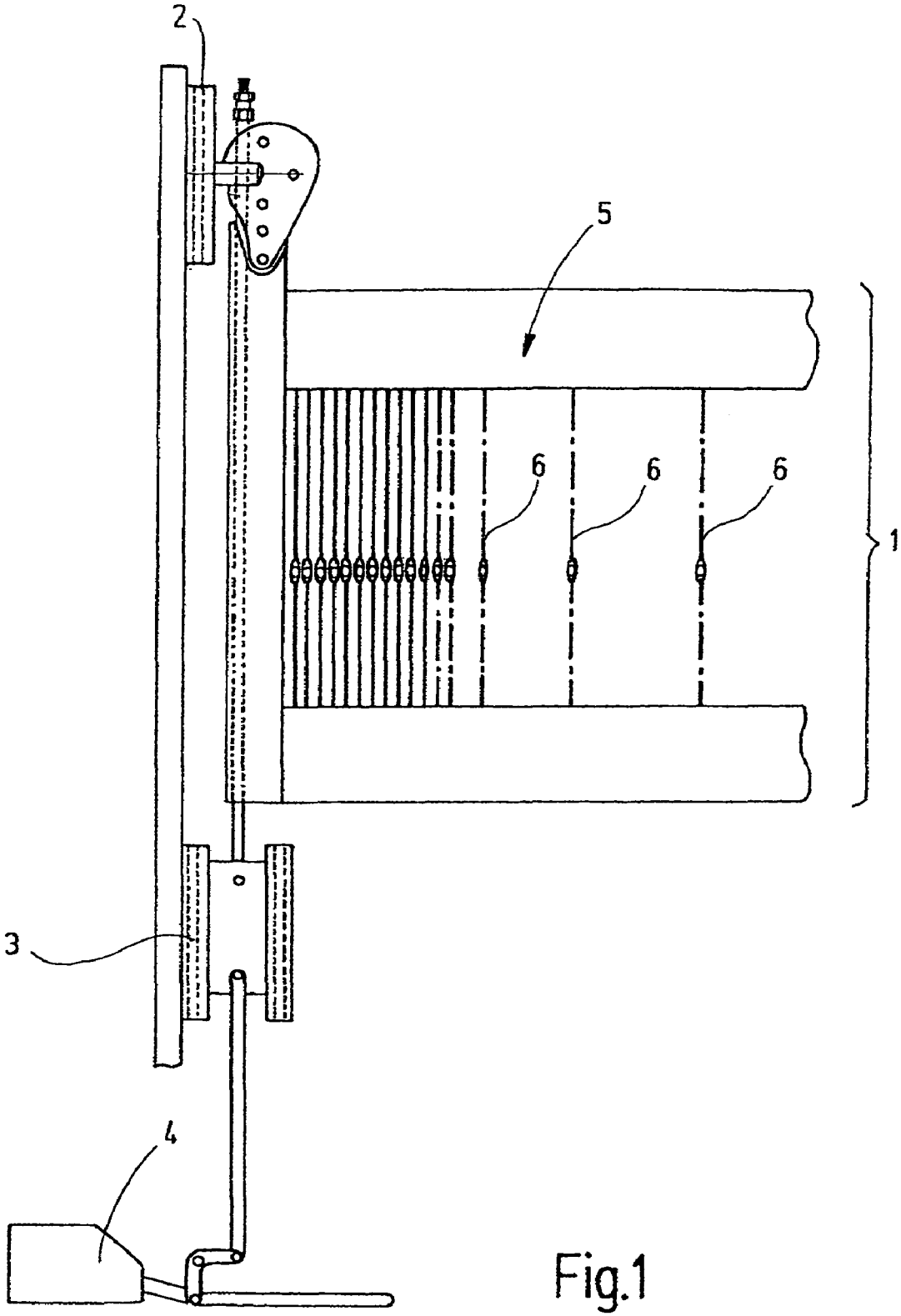
FIG. 1, a schematic, fragmentary view of a heddle shaft.
Figure 2:
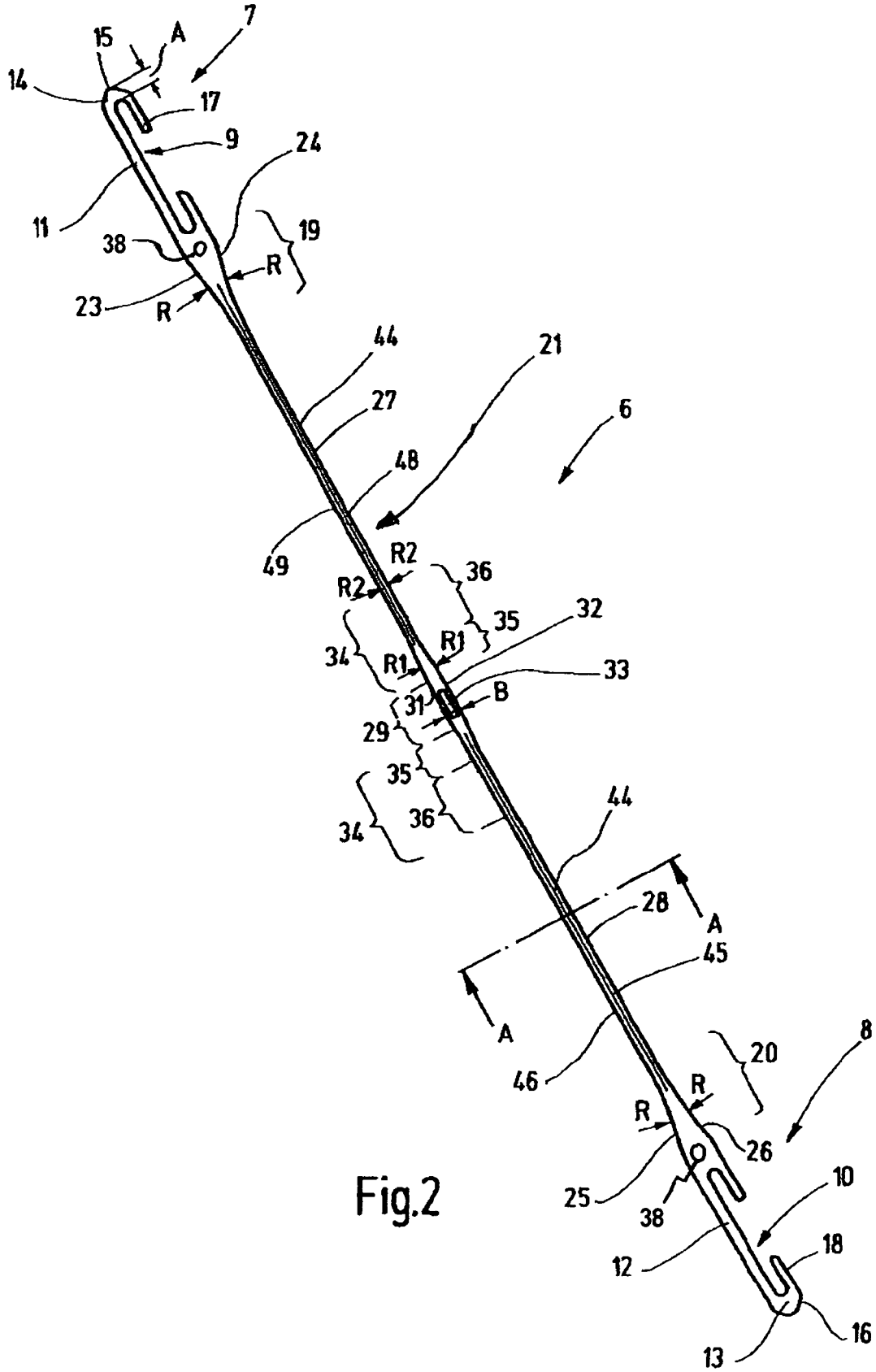
FIG. 2, a schematic side view of a heddle for the heddle shaft of FIG. 1.

In FIG. 1, a heddle shaft 1 is shown which is vertically movably supported in a power loom. To that end, it is connected to a linear guide device 2, 3 and, via a suitable rod linkage, to a drive mechanism 4. The heddle shaft 1 forms a frame 5, on which heddles 6 are retained. The heddles serve to form sheds in a power loom. The heddles 6 are embodied identically to one another. For purposes of illustration, a single heddle 6 is shown in FIG. 2.

The heddle 6 is a one-piece sheet-metal part of elongated basic shape. On each end, the heddle 6 has a so-called end eyelet 7, 8, which is provided with an opening 9, 10, or so-called C-shaped jaw opening. Differently shaped openings 9, 10 are also known, such as J- and O-shaped openings. Each jaw opening 9, 10 is defined by a respective straight, parallel-edged, strutlike portion 11, 12, which is adjoined by portions 13, 14 (jaw end region) extending in the form of a U. The portions 13, 14 each form one jaw end region. This region is embodied as rounded toward the outside, as shown in FIG. 2. The edge 15, 16 extending here can also be embodied obtusely, with a straight or rounded plateau. Beginning at the jaw end region, short extensions 17, 18 in turn extend into the jaw opening 9, 10. The portions 13, 14 that form the jaw end region can be embodied as the same size or of different sizes. At least the portion 14 has a longitudinal length A of only 2.5 mm to 3 mm. A wear reserve in view of wear inside the respective end eyelet 7 and 8 is thus formed in the jaw end region.

The end eyelets 7 and 8 are adjoined by a respective tapering end eyelet region 19, 20, inside which the width of the heddle 6 changes over from the greater width of the end eyelets 7, 8 to the lesser width of its heddle shank 21. The tapering end eyelet region 19, 20, which may be embodied symmetrically, preferably has curved edges 23, 24, 25, 26, located facing one another, whose radius is preferably at most 60 mm. In this way, tapering end eyelet regions 19, 20 that are each quite short are obtained, yet they are long enough to transmit the incident tensile and compressive forces between the end eyelet 7, 8 and the heddle shank 21 uniformly enough. In particular, local peak forces can be avoided, to the extent that no breakage will occur even at high dynamic loads. The radii of the edges 23, 24, 25, 26 are marked R in FIG. 2.

The heddle shank 21 is embodied between the tapering end eyelet regions 19, 20 and has its narrowest portions 27, 28 immediately adjacent the respective tapering end eyelet region 19, 20. The width of the shank is preferably between 1 mm and 1.6 mm.

Figure 8:
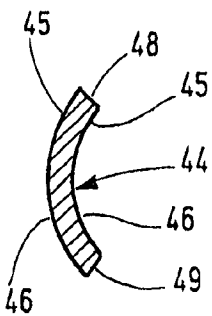
FIGS. 7, 8, a schematic cross section, on a different scale, of the heddle of FIG. 2, taken along the line A—A.
Figure 7:
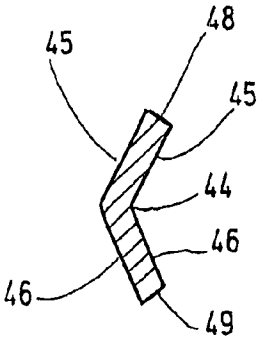

In order for the heddle 6 of the invention, whose mass has been reduced, to have adequate stability, the portions 27, 28 may be formed of face regions 45, 46. The face regions 45, 46 extend in the longitudinal direction of the heddle 6 from the yarn eyelet region 29 into the region of the end eyelets 7, 8. The face regions 45, 46 are preferably each the same size and extend, beginning at a bending edge 44 located approximately in the middle of the heddle shank 21, as far as the edges 48, 49 of the portions 27, 28. As can be seen from FIG. 7, the face regions 45, 46 form an obtuse angle. FIG. 8 shows a different embodiment of a cross section of a heddle 6 of the invention. Here the face regions 48, 49 are embodied as curved.

Figure 3:
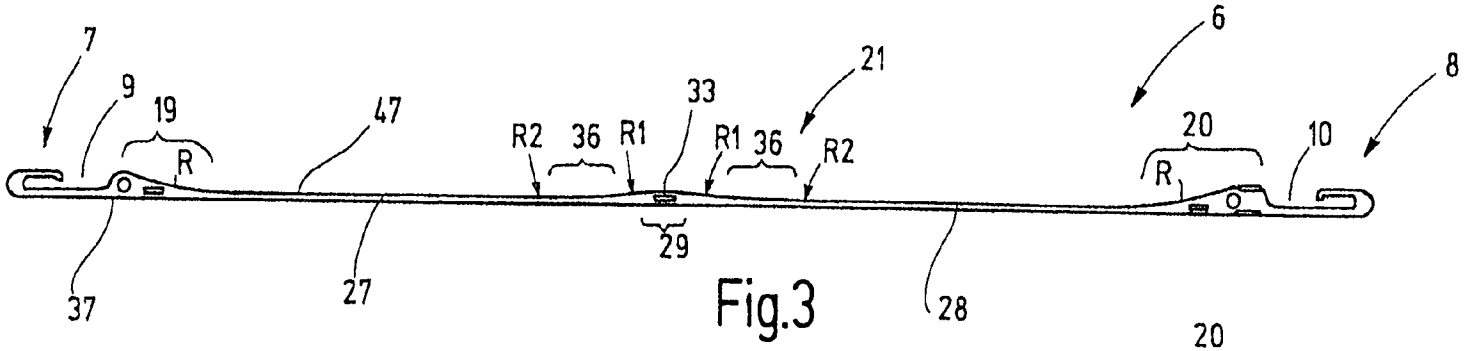
FIG. 3, a schematic side view of a modified embodiment of a heddle.
Figure 5:
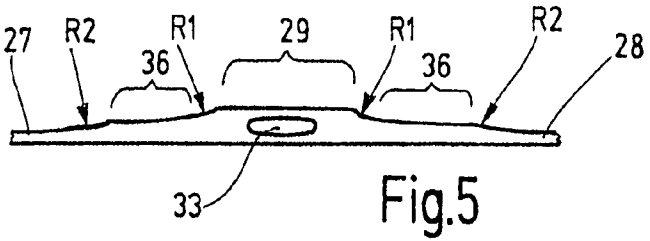
FIG. 5, a fragmentary, schematic side view on a different scale of the heddle of FIG. 3.

As FIGS. 3 and 5 show, a yarn eyelet region 29 which is defined by edges 31, 32 oriented parallel to one another is embodied approximately in the middle along the heddle shank 21. The yarn eyelet region has a width of 2.4 mm, for instance, if a yarn eyelet 33 provided here has a width of 1.2 mm. The width of the yarn eyelet region 29 is marked B in FIG. 2. Preferably, the width B amounts to twice the width of the yarn eyelet.

The yarn eyelet region 29 is adjoined by a transition region 34, which in a first portion 35 is defined by two rounded edges facing one another. Both edges have a radius R1 of approximately 60 mm or less. A second portion 36 adjoins the first portion and is defined by edges that are parallel to one another. Its width is preferably about 1.8 mm. It is somewhat greater than the width of the other portions 27, 28 of the heddle shank 21, but less than the width of the yarn eyelet region. The transition from the transition region 34, 36 to the portion 27 and 28, respectively, is again formed by curved edges, whose radii R2 are at most about 60 mm. The portion 36 preferably has a length that at most is equivalent to one and a half times the length of the yarn eyelet region 29.

On the opposite side of the yarn eyelet 33, the same kind of transition region 34 is embodied, comprising the portions 35, 36. The above description applies accordingly.

The heddle 6 described thus far is largely optimized in terms of its dynamic properties. Upon a rapid vertical motion of the heddle shaft 1, it guides the warp thread, extending through the yarn eyelet 33, without overloading individual parts or portions, even at high motion speeds. It has a low mass, which can be reduced by up to 20% compared to conventional heddles. If in conventional equipment the heddles 5 of the heddle shaft 1 weigh about 5 kg, this weight can be reduced to approximately 4 kg with heddles 5 embodied in accordance with FIG. 2 and the above description.

A modified embodiment of the heddle 6 is shown in FIG. 3. In contrast to the heddle 6 of FIG. 2, the heddle 6 of FIG. 3 is embodied asymmetrically, in the sense that its yarn eyelet 33 and jaw openings 9, 10 are not located along the same line. In particular, the heddle shank 21, including the tapering end eyelet regions 19, 20, is not embodied symmetrically to the longitudinal direction of the heddle shank 21. From the end eyelet 7, one continuous straight edge 37 extends to the end eyelet 8. The opposite edge 47, conversely, in the tapering end eyelet regions 19, 20 is embodied as curved, with a radius of at most 60 mm. This is adjoined by a straight portion which defines the portions 27, 28. With radii R2, the edge then merges with a part that is again straight and extends parallel to the edge 37, into the portion 36. This portion is part of the transition region 34, with which the edge 47, with a radius R1 of about 60 mm, finally merges with the yarn eyelet region 29. The length of the yarn eyelet region 29 is preferably less than three times the length of the elongated, oval yarn eyelet 33. If the length of this yarn eyelet is defined as 5.5 mm, then the length of the yarn eyelet region 29 is preferably less than 10 mm.

Figure 4:
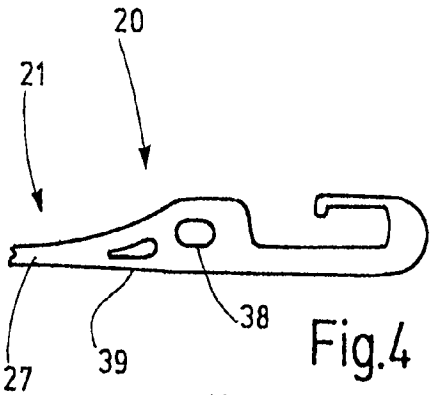
FIG. 4, a fragmentary side view on a different scale of the region of the end eyelet of the heddle of FIG. 3.

One or more openings may be embodied in the tapering end eyelet regions 19, 20. In the present exemplary embodiment, both a circular opening 38 and a slotlike opening 39 are provided in both the tapering end eyelet region 20 (FIG. 4) and the tapering end eyelet region 19. The opening 38 serves to thread the heddle 6 onto a rod, for instance for transportation purposes or for assembly. The slotlike opening 39 serves the purpose of orientation and positioning, particularly in the case of an asymmetrical embodiment of the heddle 6. Taken together, the two openings 38, 39 occupy a face region which is at least greater than one-eighth the total area of the respective tapering end eyelet region 19 or 20. For a given size of opening, this can be achieved by means of an especially small or short embodiment of the tapering end eyelet region 20, 19. Thus in comparison to heddles of the prior art, the tapering end eyelet region 20, 19 contributes to a reduced extent to the weight of the heddle 6.

Figure 6:
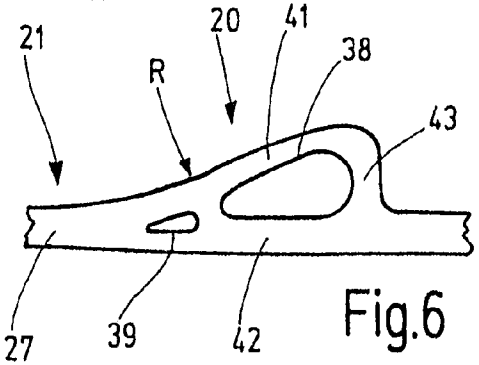
FIG. 6, a fragmentary side view of a modified embodiment of a heddle.

As FIG. 6 shows, both the tapering end eyelet region 20 and the tapering end eyelet region 19 can be provided with enlarged openings 39, 38. In particular, these openings 38, 39 may be teardrop-shaped. The spacing between the two openings 38, 39 is preferably less than the length of the slotlike opening 39. The teardrop-shaped opening 39 can be defined by two legs 41, 42, oriented in a V to one another, which are at an acute angle from one another and merge, via a rounded portion, with the portion 27 of the heddle shank 21. The two legs 41, 42 are joined to one another on their upper end by a crosspiece 43. The crosspiece 43 forms a rest for a heddle support rail. The forces originating at this crosspiece are introduced into the heddle shank 21 by the legs 41, 42 without excessively increasing the local tension. The openings 38, 39 can reduce the rigidity and hence the resonant frequency of the tapering end eyelet region 20 in the longitudinal direction of the shank. Thus shank regions near the end eyelets can be reduced or avoided.

The concept of the invention of reducing the mass by up to 20% has been described above for a heddle 6 with a so-called C-shaped end eyelet. However, the mass can also be reduced in heddles with J- and O-shaped end eyelets, of the kind known from ISO standards 11677-2 and 11677-3. To do so, the same or similar provisions as described above are employed accordingly. Primarily, the width of the heddle shank is reduced, and material is removed from the region of the end eyelets.

In a heddle 6, the slender heddle shank 21 has been lengthened, at the cost of the end eyelets 7, 8 and the yarn eyelet region 29. This is accomplished on the one hand by shortening the end eyelet regions 7, 8 to their absolute minimum length and on the other by placing the auxiliary openings 38, which serve to transport the heddles, closer to the end eyelets 7, 8. The radii R in the region of the end eyelets 7, 8 are reduced. Instead of the usual 2 mm width, the heddle shank 21 still has a maximum width of 1.6 mm. The regions 14, 13 of the heddle 6 that protrude past the end openings still have, instead of the usual length of 4 mm, a length of 2.5 mm to 3 mm. Directly around the yarn eyelet 33, the heddle has a width which, as before, is equivalent to twice the width of the yarn eyelet 33. However, the length of this region is shortened to a maximum of twice to three times the yarn eyelet width. The transition from the narrowest zone 27, 28 of the heddle shank 21 to the comparatively wide zone 29 around the yarn eyelet 33 is characterized by an elongated transition region 34, which has a maximum width of 1.8 mm and serves to reinforce this region against mechanical stresses.

List of Reference Numerals

| | |
|---|---|
| 1 | Heddle shaft |
| 2, 3 | Linear guide device |
| 4 | Drive mechanism |

-continued

| | |
|---|---|
| 5 | Frame |
| 6 | Heddle |
| 7, 8 | End eyelet |
| 9, 10 | Jaw opening |
| 11, 12, 13, 14 | Portions |
| 15, 16 | Edge |
| 17, 18 | Extensions |
| 19, 20 | Tapering end eyelet regions |
| 21 | Heddle shank |
| 23, 24, 25, 26 | Edges |
| 27, 28 | Portion |
| 29 | Yarn eyelet region |
| 31, 32 | Edges |
| 33 | Yarn eyelet |
| 34 | Transition region |
| 35, 36 | Portion |
| 37, 47 | Edge |
| 38, 39 | Opening |
| 41, 42 | Leg |
| 43 | Crosspiece |
| 44 | Bending edge |
| 45, 46 | Face regions |
| 48, 49 | Edge |
| A | Longitudinal length |
| B | Width of the yarn eyelet region |

The invention claimed is:

1. A heddle having:

at least one end eyelet which has an opening, a heddle shank, which has at least one yarn eyelet, and whose width is less than the width of yarn eyelet region, a tapering end eyelet region between each end eyelet and the heddle shank, at least one of the tapering end eyelet regions having at least one opening; and wherein the area occupied by the opening or openings of the at least one tapering end eyelet region is greater than one-eighth the total area of the at least one tapering end eyelet region, which has an edge curved in an arc, whose radius (R) is less than or equal to 60 mm.

2. A heddle having:

at least one end eyelet which has an opening, a heddle shank, which has at least one yarn eyelet, and whose width is less than the width of yarn eyelet region, and a tapering end eyelet region between each end eyelet and the heddle shank, at least one of the tapering end eyelet regions having at least two openings; and wherein the area occupied by the openings of the at least one tapering end eyelet region is greater than one-eighth the total area of the at least one tapering end eyelet region, and the openings in the at least one tapering end eyelet region have a round and/or slotlike and/or teardrop shape, with at least one of the openings being slotlike or teardrop shaped, and the spacing of the two openings from one another is at most as great as the length of the slotlike or teardrop shaped opening.

3. A heddle having at least one end eyelet, which has an opening, and one portion, embodied at the opening, on a respective outer end of the end eyelet, and wherein the portion has a length, measured in the longitudinal direction of the heddle shank, of at most 3 mm.

4. The heddle of claim 3, wherein the portion has a length that is greater than 2 mm.

5. A heddle, having a heddle shank, which has at least one yarn eyelet, and whose width is less than the width of a yarn eyelet region, and wherein the heddle shank, over the great majority of its longitudinal length, has a width of at most 1.6 mm.

6. A heddle, having a heddle shank, which has at least one yarn eyelet, and whose width is less than the width of a yarn eyelet region, and wherein the yarn eyelet region, has a width which is greater than the least width of the heddle shank; and the yarn eyelet region has a length which is at most five times as great as the width of the yarn eyelet.

7. The heddle of claim 6, wherein the length of the yarn eyelet region is at most three times as great as the width of the yarn eyelet.

8. The heddle of claim 6, wherein the yarn eyelet region, with at least one curved edge (radius R1), merges with the rest of the heddle shank.

9. The heddle of claim 8, wherein the radius (R1) of the curved edge is at most 60 mm.

10. A heddle, having a heddle shank, and a yarn eyelet region which has at least one yarn eyelet, and wherein adjoining the yarn eyelet region, a transition region is embodied which is defined at least in a portions by edges parallel to one another, and whose width is greater than the least width of the heddle shank and is less than that of the yarn eyelet region.

11. The heddle of claim 10, wherein the length of the transition region is at most as great as 1.5 times the length of the yarn eyelet region.

12. The heddle of claim 10, wherein the heddle shank has an uneven side face.

13. The heddle of claim 12, wherein the side face has face regions which form an obtuse angle with one another.

14. The heddle of claim 12, wherein the side face is curved.

15. The heddle of claim 10, wherein characterized in that the heddle shank has an uneven side face.

16. The heddle of claim 15, wherein the side face has face regions which form an obtuse angle with one another.

17. The heddle of claim 15, wherein the side face is curved.

18. The heddle of claim 5, wherein the heddle shank has an uneven side face.

19. The heddle of claim 6, wherein the heddle shank has an uneven side face.

20. The heddle of claim 19, wherein the side face has face regions which form an obtuse angle with one another.

21. The heddle of claim 19, wherein the side face is curved.

22. A heddle having:

at least one end eyelet which has an opening, a heddle shank, which has at least one yarn eyelet, and whose width is less than the width of yarn eyelet region, a tapering end eyelet region between each end eyelet and the heddle shank, with at least one of the tapering end eyelet regions having at least one opening, and wherein the area occupied by the opening or openings of the at least one tapering end eyelet region is greater than one-eighth the total area of the respective tapering end eyelet region, and, the at least one tapering end eyelet region is symmetrical with regard to the longitudinal axis of the shank.

* * * * *